United States Patent [19]

Teller et al.

[11] Patent Number: 4,596,094

[45] Date of Patent: Jun. 24, 1986

[54] PANEL FASTENER FOR A MOVABLE WALL ASSEMBLY

[75] Inventors: James L. Teller, Lake Winnebago; Albert J. Kramer, Jr., Blue Springs, both of Mo.

[73] Assignee: GTE Products Corporation, Stamford, Conn.

[21] Appl. No.: 509,529

[22] Filed: Aug. 1, 1983

Related U.S. Application Data

[63] Continuation of Ser. No. 240,054, Mar. 3, 1981.

[51] Int. Cl.[4] ..... E04B 1/00

[52] U.S. Cl. ..... 52/98; 52/486; 52/489; 52/357; 52/363

[58] Field of Search ..... 52/98, 489, 357, 363, 52/714, 715, 486, 727

[56] References Cited

U.S. PATENT DOCUMENTS

| | | | |
|---|---|---|---|
| 3,934,387 | 1/1976 | Moeller | 52/489 |
| 4,442,642 | 4/1984 | Lindner et al. | 52/98 |
| 4,471,593 | 9/1984 | Ragland | 52/489 |

*Primary Examiner*—Carl D. Friedman
*Assistant Examiner*—Naoko N. Slack
*Attorney, Agent, or Firm*—Ivan L. Ericson

[57] ABSTRACT

A panel fastener for attaching a wall panel to a flange of a vertical stud in a movable wall system. The panel fastener is fabricated from sheet metal and includes a flat body portion, pointed teeth for driving into an edge of the wall panel and a portion which engages the rear surface of the flange. The panel fastener is deformable, thus permitting the wall panel to be installed by movement toward the stud along a path perpendicular to the panel. In addition, the panel fastener is fractured during wall panel removal, thus permitting the wall panel to be removed from the stud without damage to the stud or the wall panel.

16 Claims, 11 Drawing Figures

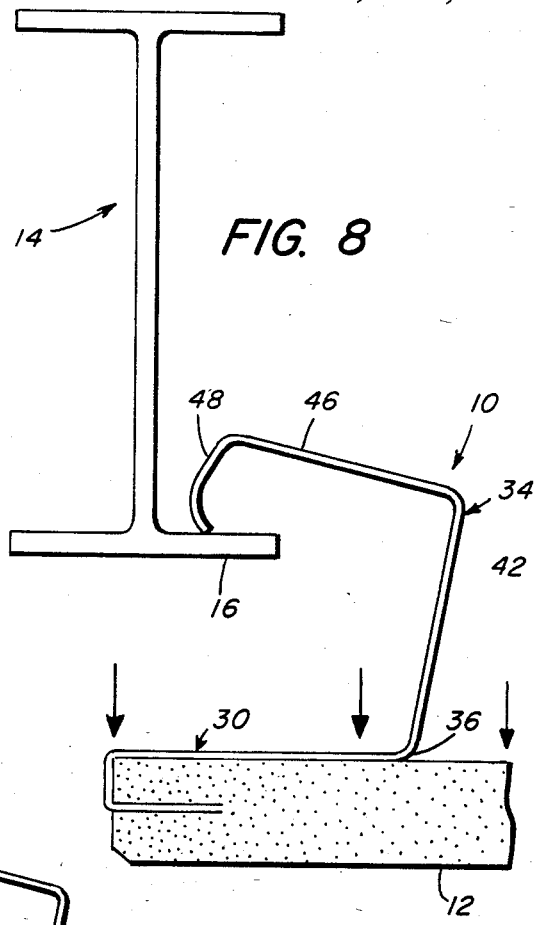
FIG. 8
FIG. 9
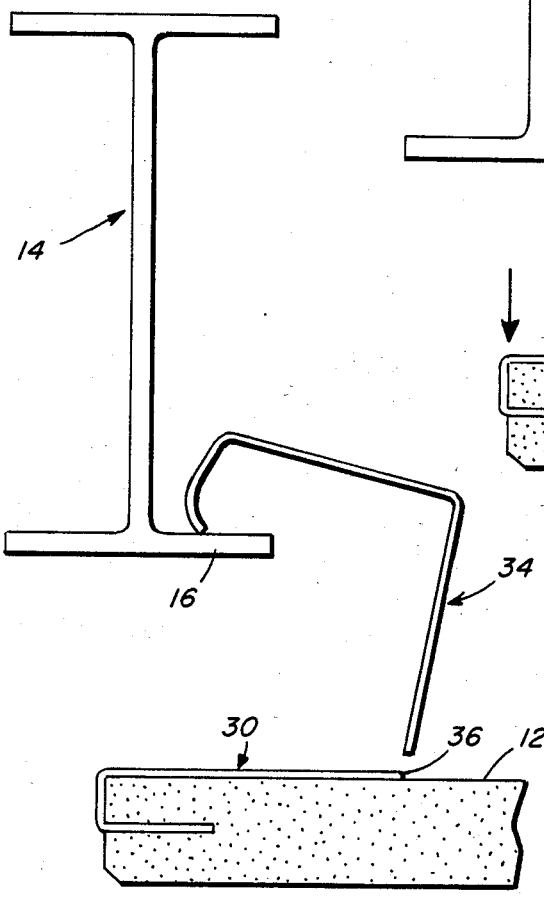
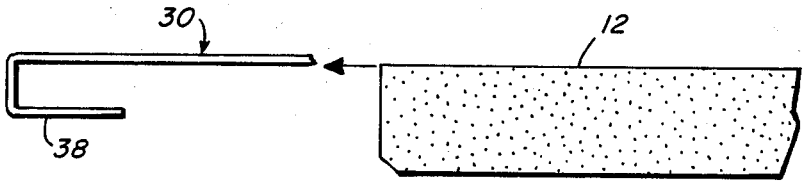
FIG. 10

PANEL FASTENER FOR A MOVABLE WALL ASSEMBLY

This is a continuation of application Ser. No. 240,054, filed Mar. 3, 1981.

BACKGROUND OF THE INVENTION

This invention relates to movable wall systems and, more particularly, to a panel fastener for attaching a wall panel to a stud, such as an I-beam, having one or more flanges.

Movable wall systems are in widespread use in office buildings and the like. They offer the ability to change the building layout in response to changing needs of the occupants at a minimum of effort and expense. In one movable wall system, I-shaped vertical studs are attached to ceiling and floor runners. Wall panels are attached to the studs using a tape having adhesive on both sides. The wall panel fits into a groove in the ceiling runner and is attached by screws to the floor runner. A base strip is snapped onto the floor runner, thus covering the screws and resulting in a wall system without exposed fasteners.

Experience has shown, however, that the tape system does not provide adequate adherence of the wall panel to the stud under certain conditions. For example, any warping or bowing outward of the wall panel from the stud makes it difficult for the tape system to achieve good adherence between the wall panel and the stud. In addition, the adherence of the wall panel to the stud is sensitive to the surface characteristics of the wall panel and to the adhesive characteristics of the tape. Any change in these characteristics by the respective manufacturers can seriously degrade the adherence of the wall panel to the tape and of the tape to the stud.

It is, therefore, desirable to provide a panel fastener which not only provides a good, reliable attachment between the wall panel and the stud but also permits the wall panel to be removed from the stud without damage to the stud or the wall panel. In addition, the panel fastener should permit the panel to be installed by movement toward the stud along a path perpendicular to the panel and should be invisible in the assembled wall system.

SUMMARY OF THE INVENTION

According to the present invention, there is provided a panel fastener for attaching a wall panel to a stud having a flange disposed parallel to the plane of the wall panel. The panel fastener includes a flat body portion having a front face for positioning on the rear surface of the wall panel, means associated with one end of the body portion for attaching the body portion to the rear surface of the wall panel and flange engaging means. A first portion of the flange engaging means is attached by a frangible web to the opposite end of the body portion and extends away from the rear face of the body portion at an acute angle. A second portion of the flange engaging means is attached to the first portion and extends toward the body portion at an oblique angle. The second portion has a distal end proximate the rear surface of the body portion and is adapted for engaging the rear surface of the flange. The flange engaging means is deformable to permit movement past the flange during installation of the wall panel and is detachable at the frangible web from the body portion to permit removal of the wall panel. The panel can be installed by movement toward the stud along a path substantially perpendicular to the panel and can be removed.

In a preferred embodiment, the flange engaging means is generally V-shaped with the first and second portions forming the legs of the V. The means for attaching the body portion to the wall panel includes a plurality of pointed teeth which are parallel to the body portion and are directed toward the opposite end of the body portion for driving into an edge of the panel.

According to another aspect of the present invention, a movable wall assembly includes a wall panel, a pair of studs for mounting of the wall panel and a plurality of panel fasteners for connecting the wall panel to the studs. Each stud includes a flange disposed parallel to the plane of the wall panel. The panel fasteners have the above-described configuration including a flat body portion, means for attaching the body portion to the rear surface of the wall panel and flange engaging means.

BRIEF DESCRIPTION OF THE DRAWINGS

In the drawings:

FIGS. 8 and 9 illustrate the removal of a wall panel from a stud;

FIG. 10 illustrates the removal of the panel fastener from the wall panel.

For a better understanding of the present invention, together with other and further objects, advantages and capabilities thereof, reference is made to the following disclosure and appended claims in connection with the above-described drawings.

DETAILED DESCRIPTION OF THE INVENTION

Figure 5:
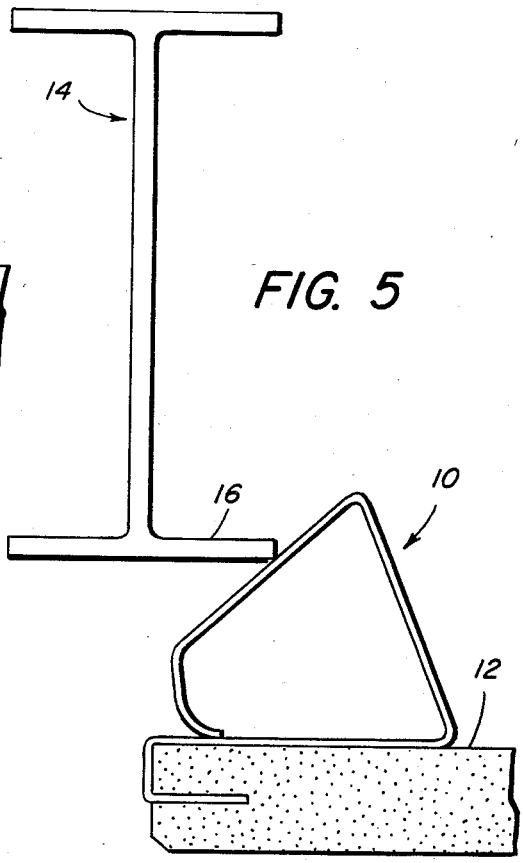
FIGS. 5, 6 and 7 illustrate the installation of a wall panel and panel fastener combination on a stud.
Figure 6:
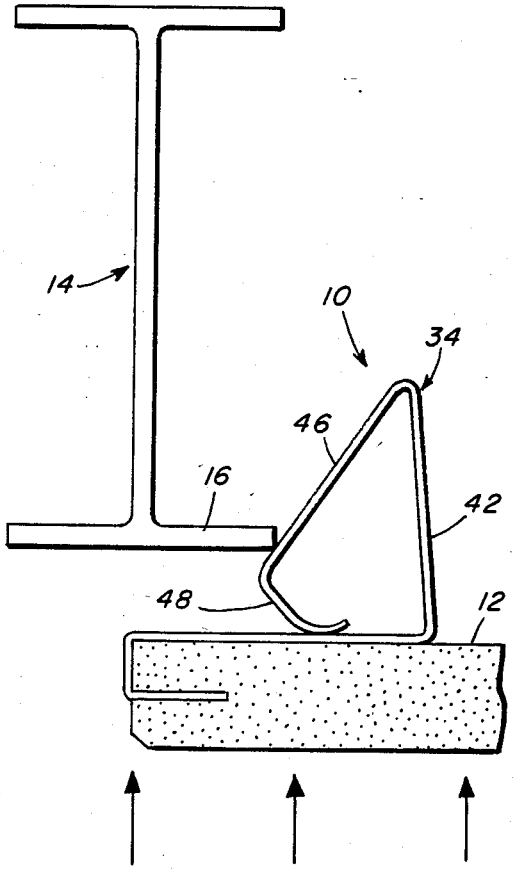
Figure 7:
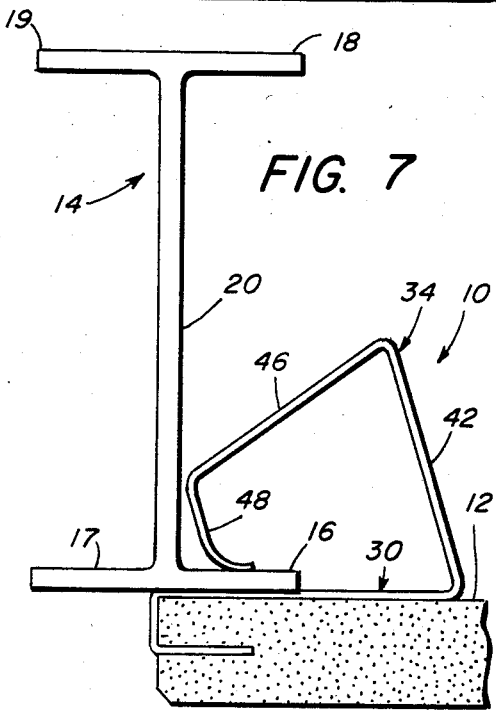

Referring now to FIGS. 1–7, there is shown a panel fastener 10 in accordance with the present invention. As best shown in FIG. 7, the panel fastener 10 is utilized for attaching a wall panel 12 to a stud 14 in a movable wall system. The wall panel 12 is a flat rectangular panel, typically a gypsum wallboard. The stud 14 includes at least one flange 16 parallel to the wall panel 12 and is typically an I-beam having two front flanges 16,17 connected to two rear flanges 18,19 by a web 20, as shown in FIG. 7. After installation of the panel 12 on the stud 14, the rear surface of the panel 12 rests against the front surface of the flange 16 and is held in position by the panel fastener 10 as described more fully hereinafter. Additional wall panels (not shown) can be attached to the flanges 17,18,19 to form part of a two-sided wall system.

Figure 1:
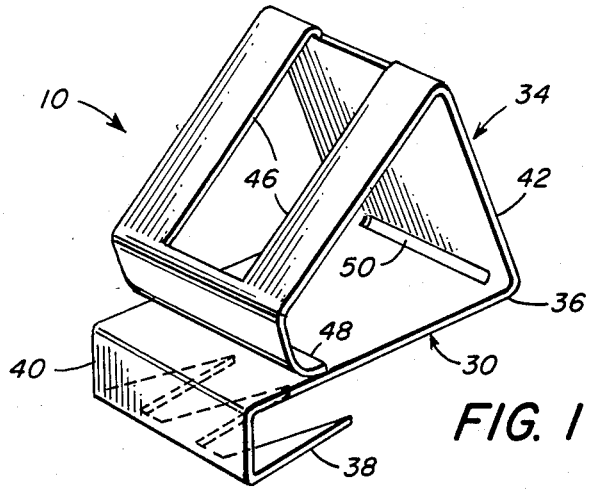
FIG. 1 is a perspective view of a panel fastener in accordance with the present invention.
Figure 2:
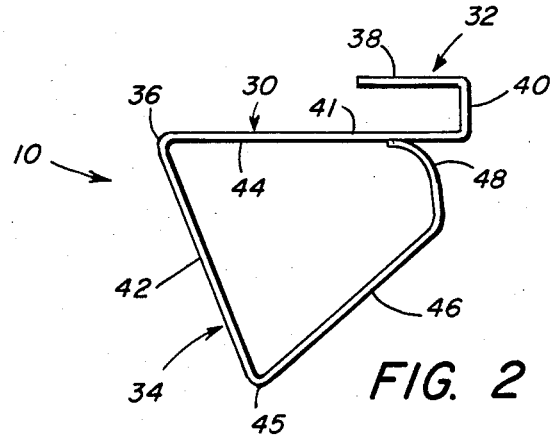
FIG. 2 is a top view of the panel fastener illustrated in FIG. 1.
Figure 3:
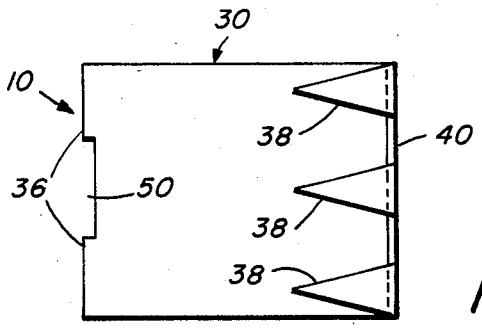
FIG. 3 is a front view of the panel fastener illustrated in FIG. 1.

Referring now to FIGS. 1–3, the panel fastener 10 includes a flat body portion 30, panel attachment means 32 for attaching the body portion 30 to the rear surface of the wall panel and flange engaging means 34. The panel attachment means 32 is connected to one end of the body portion 30. The flange engaging means 34 is attached by a frangible web 36 to the opposite end of the body portion 30. Although the body portion 30 is typically a flat rectangular piece of sheet metal, it can have any convenient shape. The entire panel fastener 10 is typically a unitary construction fabricated from a single piece of sheet metal which is cut or stamped and bent to the desired shape.

The panel attachment means 32 includes a plurality of pointed teeth 38 and an end portion 40 which connects the teeth 38 to the one end of the body portion 30. The teeth 38 are spaced from the front face 41 of the body portion 30, are parallel to the body portion 30 and are directed toward the opposite end of the body portion 30. The end portion 40 is perpendicular to the teeth 38 and the body portion 30. The teeth 38 and the end portion 40 are formed as two right angle bends in the sheet metal. During installation of the panel fastener 10, the teeth 38 are driven into the edge of the wall panel. The end portion 40 which determines the spacing between the teeth 38 and the body portion 30 typically has a length of about one-half the thickness of the wall panel, thus insuring that the teeth 38 are driven into the center of the wall panel.

The flange engaging means 34 includes a first portion 42 connected by the frangible web 36 to the opposite end of the body portion 30. The first portion 42 extends away from the rear face 44 of the body portion at an acute angle. The flange engaging means 34 further includes a second portion 46 connected to the first portion 42 at the point 45. The second portion 46 extends from its connection point 45 with the first portion 42 toward the rear face 44 of the body portion 30 at an oblique angle. The second portion 46 includes a distal end 48 proximate the rear face 44 of the body portion 30. The distal end 48 engages the rear surface of the flange 16 when installed as described hereinafter. The distal end 48 of the second portion 46 is curved inwardly toward the first portion 42, thereby providing a curved surface, rather than a relatively sharp sheet metal edge, for contacting the rear surface of the flange 16, as shown in FIG. 7. The curved contact surface facilitates sliding movement of the distal end 48 along the rear surface of the flange 16 during installation.

The flange engaging means 34 is formed of spring metal and in the example shown in FIGS. 1–3 is generally V-shaped with the first portion 42 and the second portion 46 forming the legs of the V. The connection point 45 between the first portion 42 and the second portion 46 is simply a sharp bend in the sheet metal of the fastener 10. As will be obvious to those skilled in the art, the connection between the first and second portions of the flange engaging means can be a bend or curve of considerably larger radius than that shown in FIGS. 1–3.

The application to the second portion 46 of a force perpendicular to the body portion 30 and directed toward the body portion 30 results in a deflection of the second portion 46 toward the first portion 42. A force is applied to the frangible web 36 but not a sufficient force to cause fracture thereof. When the force is removed, the flange engaging means 34 returns to its original shape due to the spring characteristics of the metal. An aperture can be cut in the sheet metal at the connection point 45 of the first portion 42 and the second portion 46, as best shown in FIG. 1, in order to obtain the desired flexing characteristics between the first portion 42 and the second portion 46.

The application to the distal end 48 of the second portion 46 of a force perpendicular to the body portion 30 and directed away from the body portion 30 results in fracture of the frangible web 36 and detachment of the flange engaging means 34 from the body portion 30 at the frangible web 36. The frangible web 36 is typically made by cutting away a portion of the metal connecting the body portion 30 and the flange engaging means 34. As shown in FIG. 3, a slot 50 is cut in the sheet metal, thus reducing the amount of material in the region of the frangible web 36 and producing a weak point in the fastener 10 which is fractured when the flange engaging means 34 is moved relative to the body portion 30.

In one example of a panel fastener as described hereinabove, the body portion 30 is 1.5 in. long$\times$1.25 in. wide and the flange engaging means 34 extends to the rear of the body portion 30 by 1.25 in. The material is 25 gauge steel tempered to a Rockwell hardness of 54 to obtain the desired flange engaging means spring characteristics.

Figure 4:
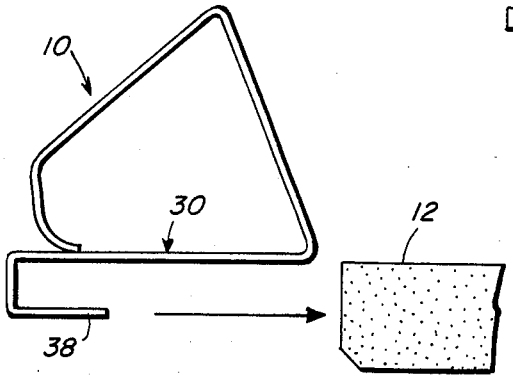
FIG. 4 illustrates the installation of a panel fastener on a wall panel.

The installation of a panel fastener 10 on a wall panel 12 is illustrated in FIG. 4. The body portion 30 of the panel fastener 10 is positioned on the rear surface of the wall panel 12 adjacent an edge thereof and the teeth 38 are driven into the edge of the wall panel 12 with a hammer or similar tool. One or more panel fasteners 10 can be installed on the left and right edges of the wall panel 12.

The installation of a wall panel 12 and panel fastener 10 on a stud 14 is illustrated in FIGS. 5–7. Initially the wall panel 12 is positioned with the edge of the panel 12 in front of the flange 16, as shown in FIG. 5. If the wall system includes a ceiling runner with a groove, the top edge of the wall panel 12 is first inserted in the groove. The wall panel 12 is then moved toward the stud 14 on a path substantially perpendicular to the wall panel 12 by the application of a force to the front surface of the wall panel 12 as indicated by the arrows in FIG. 6. As the wall panel 12 is pressed inward, the flange 16 exerts a force on the second portion 46 of the flange engaging means 34 causing the second portion 46 to be deflected toward the first portion 42 and permitting the flange engaging means 34 to move past the flange 16. After the distal end 48 of the second portion 46 moves past the flange 16, the deflecting force is no longer applied and the flange engaging means 34 returns to its original shape as shown in FIG. 7. The distal end 48 of the second portion 46 is now in contact with the rear surface of the flange 16. Thus, the flange 16 is clamped between the distal end 48 of the second portion 46 and the body portion 30, and the wall panel 12 is firmly attached to the stud 14.

When the movable wall assembly described herein is to be moved, the wall panels are removed from the studs, the studs are moved to the new location and the wall panels are reinstalled. Removal of the wall panel 12 from the stud 14 is illustrated in FIGS. 8 and 9. The wall panel 12 is moved away from the stud 14 by the application of a force to the rear surface of the wall panel 12 as indicated by the arrows in FIG. 8. The removal can be initiated by inserting a sharp object such as a screwdriver between the wall panel 12 and the stud 14. As the wall panel 12 is moved away from the stud 14, the body portion 30 of the fastener 10 remains attached to the wall panel 12 while the distal end 48 of the second portion 46 is prevented from moving by the flange 16. This causes a deformation of the fastener 10 and the application of a force to the frangible web 36, as shown in FIG. 8. At some point during the removal of the wall panel 12, the frangible web 36 breaks and the flange engaging means 34 is detached from the body portion 30, thus completely detaching the wall panel 12 from the stud 14. The body portion 30 of the fastener 10 and the teeth 38, which remain attached to the wall panel 12, can be removed from the wall panel 12, as shown in FIG. 10, by applying a force to the opposite end of the body portion 30. The panel is now ready for reinstallation in a new location.

Figure 11:
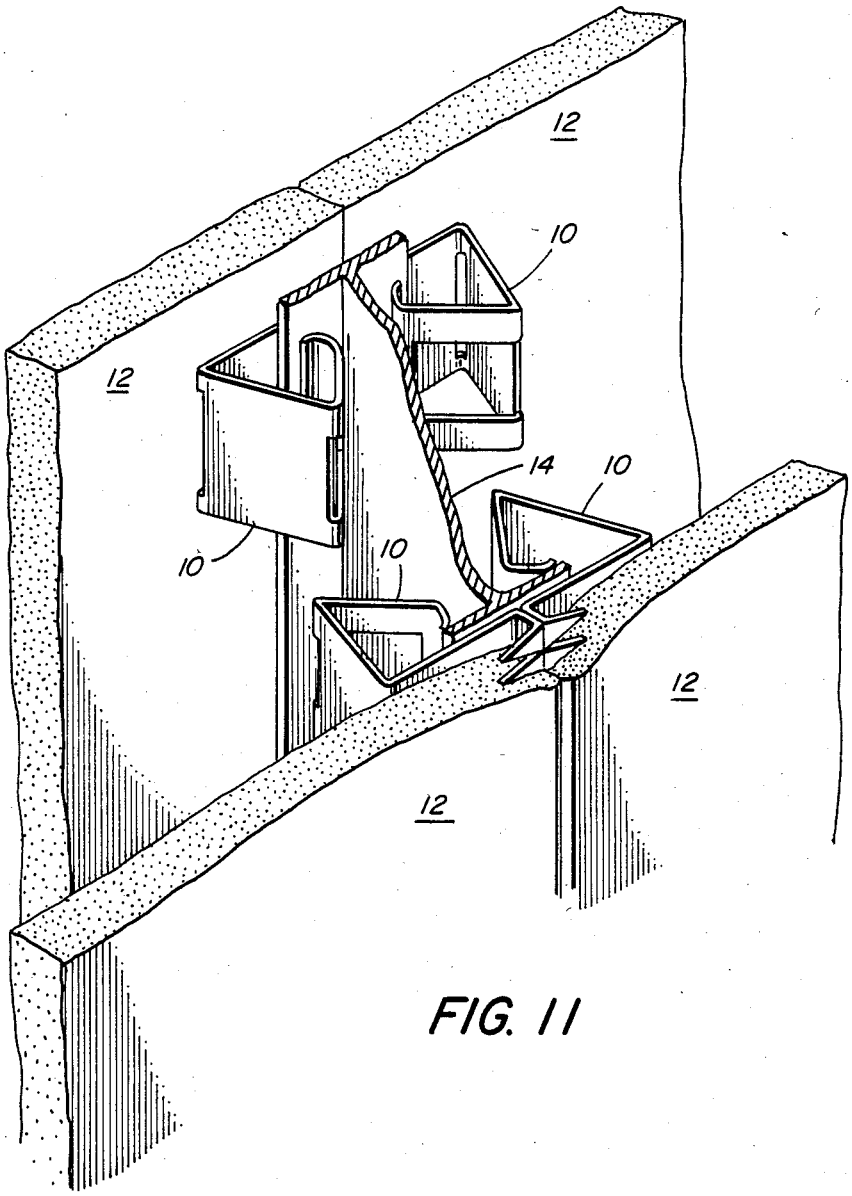
FIG. 11 is a cutaway view of a movable wall assembly in accordance with the present invention.

A movable wall system utilizing panel fasteners in accordance with the present invention is illustrated in FIG. 11. Four panels 12 are attached to a stud 14 utilizing panel fasteners 10 as shown and described hereinabove. In a typical system the stud 14 is supported by ceiling and floor runners (not shown). During installation each panel 12 is first inserted in a slot in the ceiling runner and then moved in a path substantially perpendicular to the panel 12 toward the stud 14 until the panel fasteners 10 have engaged the flange of the stud 14. Screws are then used to attach the wall panel 12 to the bottom runner. In addition to the panel fasteners described hereinabove, a tape system, located between the wall panel and the stud and utilizing a tape with adhesive on both sides, can be used to provide a composite fastening system. Alternatively, a strip of sound deadening material such as foam tape can be located between the edge of the wall panel and the stud to reduce sound transmission through the wall system.

Thus, there is provided by the present invention a panel fastener which is not exposed to view after installation of the panel, which permits the panel to be installed by movement of the panel toward the stud along a path substantially perpendicular to the panel and which permits removal of the wall panel from the stud without damage to the wall panel or the stud. In addition, there is provided a movable wall system utilizing the disclosed panel fastener. While there has been shown and described what is at present considered the preferred embodiments of the invention, it will be obvious to those skilled in the art various changes and modifications may be made therein without departing from the scope of the invention as defined by the appended claims.

What is claimed is:

1. A panel fastener for attaching a wall panel to a stud having a flange disposed parallel to the plane of the wall panel, said wall panel having a rear surface, and said flange having a rear surface, said panel fastener comprising:

a flat body portion having a rear face, a rear surface, an opposite end, and a front face for positioning on the rear surface of the wall panel;

means associated with one end of said body portion for attaching said body portion to the rear surface of the wall panel adjacent an edge of the wall panel; and flange engaging means having a spring action, said flange engaging means including a first portion, attached by a frangible web to the opposite end of said body portion, extending away from the rear face of said body portion at an acute angle and a second portion, attached to said first portion, extending toward said body portion at an oblique angle, said second portion having a distal end proximate the rear surface of said body portion and being adapted for engaging the rear surface of the flange, said flange engaging means being deformable to permit movement past the flange during installation of the wall panel, whereby the panel can be installed by movement toward the stud along a path substantially perpendicular to the panel and can be removed, said second portion of said flange engaging means being adapted to deflect toward said first portion during installation of said wall panel by a force exerted by the edge of said front surface of said flange, said force being sufficient to deflect said second portion of said panel fastener to allow the edge of said front surface of said flange to engage said rear face of said body portion without breaking said frangible web, said distal end of said second portion being adapted to slide across said rear surface of said flange past the edge of said flange by said spring action of said flange engaging means and to rest on top of said rear surface of said flange;

said flange engaging means being detachable at said frangible web from said body portion during removal of said wall panel; thereby permitting removal of said wall panel, said distal end of said flange engaging means being adapted to grip said rear surface of said flange during the removal of said wall panel, during the removal of said wall panel a force is applied to said distal end by said flange, said force being transferred from said distal end through said second and first portions of said flange engaging means to said frangible web, said force being sufficient to break said frangible web; thereby, allowing said wall panel to be removed.

2. The panel fastener as defined in claim 1 wherein said flange engaging means is generally V-shaped, said first and second portions forming the legs of the V.

3. The panel fastener as defined in claim 2 wherein said distal end of said second portion is curved inwardly toward said first portion, thereby providing a curved surface for contacting the flange.

4. The panel fastener as defined in claim 3 wherein said second portion of said flange engaging means is deflected toward said first portion of said flange engaging means upon application to said second portion of a force perpendicular to said body portion and directed toward said body portion.

5. The panel fastener as defined in claim 4 wherein said flange engaging means is detached from said body portion upon application to said second portion of said flange engaging means of a force perpendicular to said body portion and directed away from said body portion.

6. The panel fastener as defined in claim 5 wherein said fastener is formed of sheet metal.

7. The panel fastener as defined in claim 6 wherein said frangible web includes a weakened sheet metal region connecting said flange engaging means and said body portion.

8. A panel fastener for attaching a wall panel to a stud having a flange disposed parallel to the plant of the wall panel, said wall panel having a rear surface, and said flange having a rear surface, said panel fastener comprising:

a flat body portion having a rear face, a rear surface, an opposite end, and a front face for positioning on the rear surface of the wall panel;

panel attachment means attached to one end of said body portion, said panel attachment means including a plurality of pointed teeth, which are spaced from the front face of said body portion, are parallel to said body portion and are directed toward the opposite end of said body portion, for driving into an edge of the panel; and a generally V-shaped flange engaging means having a spring action, said flange engaging means including a first portion, attached by a clangible web to the opposite end of said body portion, extending away from the rear face of said body portion at an acute angle and a second portion, attached to said first portion, extending toward said body portion at an oblique angle, said second portion having a distal end which is proximate the rear surface of said body portion and is curved inwardly toward said first portion, said flange engaging means being deformable to permit movement past the flange during installation of the wall panel, whereby the panel can be installed by movement toward the stud along a path substantially perpendicular to the panel and can be removed, said second portion of said flange engaging means being adapted to deflect toward said first portion during installation of said wall panel by a force exerted by the edge of said front surface of said flange, said force being sufficient to deflect said second portion of said panel fastener to allow the edge of said front surface of said flange to engage said rear face of said body portion without breaking said frangible web, said distal end of said second portion being adapted to slide across said rear surface of said flange past the edge of said flange by said spring action of said flange engaging means and to rest on top of said rear surface of said flange;

said flange engaging means being detachable at said frangible web from said body portion during removal of said wall panel; thereby permitting removal of said wall panel, said distal end of said flange engaging means being adapted to grip said rear surface of said flange during the removal of said wall panel, during the removal of said wall panel a force is applied to said distal end by said flange, said force being transferred from said distal end through said second and first portions of said flange engaging means to said frangible web, said force being sufficient to break said frangible web; thereby, allowing said wall panel to be removed.

9. The panel fastener as defined in claim 8 wherein said fastener is formed of sheet metal.

10. The panel fastener as defined in claim 9 wherein said panel attachment means further includes an end portion perpendicular to said body portion and said teeth for interconnecting said teeth and the one end of said body portion.

11. The panel fastener as defined in claim 10 wherein said second portion of said flange engaging means is deflected toward said first portion of said flange engaging means upon application to said second portion of a force perpendicular to said body portion and directed toward said body portion.

12. The panel fastener as defined in claim 11 wherein said flange engaging means is detached from said body portion upon application to said second portion of said flange engaging means of a force perpendicular to said body portion and directed away from said body portion.

13. A movable wall assembly comprising:

a wall panel, said wall panel having a rear surface;

a pair of studs for mounting of said wall panel, each stud including a flange disposed parallel to the plane of said wall panel, said flange having a rear surface; and a plurality of panel fasteners for connecting said wall panel to said studs, each panel fastener including a flat body portion having a rear face, a rear surface, an opposite end, and a front face positioned on the rear surface of the wall panel;

means associated with one end of said body portion for attaching said body portion to the rear surface of the wall panel adjacent an edge of the wall panel; and flange engaging means having a spring action, said flange engaging means including a first portion, attached by a frangible web to the opposite end of said body portion, extending away from the rear face of said body portion at an acute angle and a second portion, attached to said first portion, extending toward said body portion at an oblique angle, said second portion having a distal end engaging the rear surface of the flange, said flange engaging means being deformable to permit movement past the flange during installation of the wall panel, whereby the panel can be installed by movement toward the stud along a path substantially perpendicular to the panel and can be removed, said second portion of said flange engaging means being adapted to deflect toward said first portion during installation of said wall panel by a force exerted by the edge of said front surface of said flange, said force being sufficient to deflect said second portion of said panel fastener to allow the edge of said front surface of said flange to engage said rear face of said body portion without breaking said frangible web, said distal end of said second portion being adapted to slide across said rear surface of said flange past the edge of said flange by said spring action of said flange engaging means and to rest on top of said rear surface of said flange;

said flange engaging means being detachable at said frangible web from said body portion during removal of said wall panel; thereby permitting removal of said wall panel, said distal end of said flange engaging means being adapted to grip said rear surface of said flange during the removal of said wall panel, during the removal of said wall panel a force is applied to said distal end by said flange, said force being transferred from said distal end through said second and first portions of said flange engaging means to said frangible web, said force being sufficient to break said frangible web; thereby, allowing said wall panel to be removed.

14. The wall assembly as defined in claim 13 wherein said second portion of said flange engaging means is deflected toward said first portion of said flange engaging means upon application to said second portion of a force perpendicular to said body portion and directed toward said body portion.

15. The wall assembly as defined in claim 14 wherein said flange engaging means is detached from said body portion upon application to said second portion of said flange engaging means of a force perpendicular to said body portion and directed away from said body portion.

16. The wall assembly as defined in claim 15 wherein said means for attaching said body portion to said wall panel includes a plurality of pointed teeth, which are parallel to said body portion and are directed toward the opposite end of said body portion, for driving into an edge of the panel and an end portion perpendicular to said body portion and said teeth for interconnecting said teeth and the one end of said body portion.

* * * * *